US008554546B2

(12) United States Patent
Kida et al.

(10) Patent No.: US 8,554,546 B2
(45) Date of Patent: Oct. 8, 2013

(54) APPARATUS AND METHOD FOR CALCULATING A FUNDAMENTAL FREQUENCY CHANGE

(75) Inventors: Yusuke Kida, Kanagawa-ken (JP); Takashi Masuko, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1064 days.

(21) Appl. No.: 12/556,382

(22) Filed: Sep. 9, 2009

(65) Prior Publication Data

US 2010/0082336 A1 Apr. 1, 2010

(30) Foreign Application Priority Data

Sep. 26, 2008 (JP) ..... P2008-248000

(51) Int. Cl.
*G10L 19/00* (2013.01)

(52) U.S. Cl.
USPC ..... 704/206; 704/207; 704/236

(58) Field of Classification Search
USPC ..... 704/206, 207, 236
See application file for complete search history.

(56) References Cited

U.S. PATENT DOCUMENTS

2009/0048835 A1 2/2009 Masuko
2009/0222259 A1 9/2009 Kida et al.

FOREIGN PATENT DOCUMENTS

JP 2940835 6/1999

OTHER PUBLICATIONS

Asano, Tetsuo, and Naoki Katoh. "Variants for the Hough transform for line detection." Computational Geometry 6.4 (1996): 231-252.*
Parsons "Voice and Speech Processing" McGraw-Hill Book Company, 1987, pp. 203-205.*
Iwano, K. et al, "Noise Robust Speech Recognition Using $F_0$ Contour Extracted by Hough Transform," Proceedings of IEEE International Conference on Acoustics, Speech, & Signal Processing, pp. 941-944, (2002).

* cited by examiner

*Primary Examiner* — Vincent P Harper
(74) *Attorney, Agent, or Firm* — Finnegan, Henderson, Farabow, Garrett & Dunner, L.L.P.

(57) ABSTRACT

A logarithmic frequency spectrum within a predetermined time range is calculated from a speech signal. The logarithmic frequency spectrum has a frequency element at equal intervals along a logarithmic frequency axis. A logarithmic frequency spectrogram is calculated by connecting a plurality of logarithmic frequency spectrums. A value of the frequency element along a straight line on the logarithmic frequency spectrogram is voted onto a Hough plane. The Hough plane has a voted value in correspondence with a gradient of the straight line. The voted value above a threshold and the gradient corresponding to the voted value are extracted from the Hough plane. A fundamental frequency change is calculated using the voted value and the gradient extracted.

9 Claims, 7 Drawing Sheets

APPARATUS AND METHOD FOR CALCULATING A FUNDAMENTAL FREQUENCY CHANGE

CROSS-REFERENCE TO RELATED APPLICATIONS

This application is based upon and claims the benefit of priority from Japanese Patent Application No. 2008-248000, filed on Sep. 26, 2008; the entire contents of which are incorporated herein by reference.

FIELD OF THE INVENTION

The present invention relates to a technique for calculating a fundamental frequency change.

BACKGROUND OF THE INVENTION

As one element of prosodic information of a speech, a fundamental frequency change per unit time exists. From the fundamental frequency change, various information such as an accent, an intonation, and voiced/voiceless, is acquired. Accordingly, the fundamental frequency change is used for a speech recognition apparatus and a speaker identification apparatus. In order to acquire the fundamental frequency change, a fundamental frequency is extracted from each frame (each period), and a difference of the fundamental frequency between two adjacent frames along a temporal direction. This difference represents the fundamental frequency change.

However, in this case, it often happens that the fundamental frequency is erroneously extracted. As a result, the fundamental frequency change is also erroneously calculated. Recently, a method for acquiring the fundamental frequency change not affected so much by an extraction error of the fundamental frequency is proposed. For example, this method is disclosed in Japanese Patent No. 2940835 ( . . . Reference 1). In this method, a crosscorrelation function between an autocorrelation function of a predicted residual of some timing (a frame) and an autocorrelation function of a predicted residual of another timing (another frame) is calculated, and a peak value of the crosscorrelation function is extracted. By using the peak value without extracting a pitch, the fundamental frequency change not having an extraction error of the fundamental frequency is acquired.

However, in this method, the fundamental frequency change is acquired based on the predicted residual of a speech. Accordingly, under the influence of a background noise, a shift amount of the maximum crosscorrelative value is different from the fundamental frequency change, and the fundamental frequency change is not correctly acquired.

Furthermore, the autocorrelation function of the predicted residual has a peak at a position of integral number times of the fundamental frequency. However, a shift amount of a peak at the position of integral number times is integral number times as much as a shift amount of the fundamental frequency. In order to correctly acquire the fundamental frequency change, a range of the autocorrelation function of the predicted residual (to calculate the crosscorrelative function) should be set at a correct fundamental frequency. Accordingly, the fundamental frequency should be previously acquired or a range of the fundamental frequency should be suitably set based on a pitch of speaker's voice. However, the range of the fundamental frequency cannot be suitably set. As a result, without limiting the range of the fundamental frequency, the fundamental frequency change having a reduced influence of the background noise is desired to be acquired.

SUMMARY OF THE INVENTION

The present invention is directed to an apparatus and a method for calculating a fundamental frequency change having the reduced influence of the background noise without limiting a range of the fundamental frequency.

According to an aspect of the present invention, there is provided an apparatus for calculating a fundamental frequency change, comprising: a spectrogram calculation unit configured to calculate a logarithmic frequency spectrum within a predetermined time range from a speech signal, the logarithmic frequency spectrum having a frequency element at equal intervals along a logarithmic frequency axis, and calculate a logarithmic frequency spectrogram by connecting a plurality of logarithmic frequency spectrums; a Hough transform unit configured to vote a value of the frequency element along a straight line on the logarithmic frequency spectrogram onto a Hough plane, the Hough plane having a voted value in correspondence with a gradient of the straight line; an extraction unit configured to extract the voted value larger than a threshold and the gradient corresponding to the voted value from the Hough plane; and a change calculation unit configured to calculate a fundamental frequency change using the voted value and the gradient extracted.

DETAILED DESCRIPTION OF THE EMBODIMENTS

Figure 1:
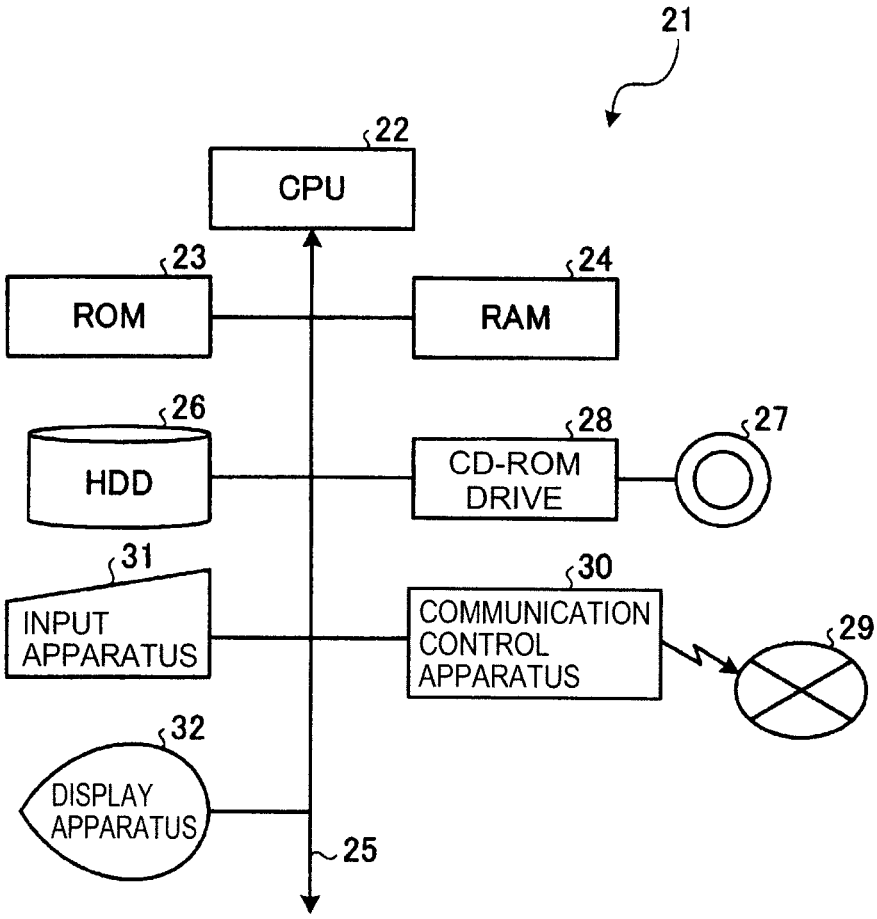
FIG. 1 is a hardware component of a speech recognition apparatus 21 of one embodiment.

Hereinafter, an apparatus and a method for calculating a fundamental frequency change according to one embodiment is explained. First, a principle used by one embodiment is explained. A voiced sound accompanying with vibration of a vocal chords has strongly elements of a fundamental frequency and a harmonic frequency (having integral number times as much as the fundamental frequency). Briefly, in case that the fundamental frequency at time j ($0<j\leq J$) is $f_j$, a frequency element $m\cdot f_j$ ($1\leq m\leq M$) is strong. This relationship of the frequency element of the voiced sound is called a harmonic structure, and each frequency element comprising the harmonic structure is called a harmonic element. As to a logarithmic fundamental frequency $\log f_j$ along a logarithmic frequency axis, the harmonic structure is represented as an equation (1).

$$\begin{aligned} \log 2f_j &= \log f_j + \log 2 \\ \log 3f_j &= \log f_j + \log 3 \\ &\vdots \\ \log mf_j &= \log f_j + \log m \end{aligned} \tag{1}$$

In the equation (1), a logarithm $\log mf_j$ of m-th harmonic frequency is a value that a predetermined offset log m is added to a logarithmic fundamental frequency $\log f_j$. Furthermore, a logarithmic fundamental frequency change $d_j$ per unit time at time j is represented as an equation (2).

$$d_j = \frac{\Delta \log f_j}{\Delta j} \tag{2}$$

In this case, if the logarithmic fundamental frequency change is constant in a time section [j−n:j+n], an equation (3) is concluded.

$$d_{j-n}=d_{j-n+1}=\ldots=d_j=d_{j+n-1}=d_{j+n} \tag{3}$$

In the equation (3), a time sequence of the logarithmic fundamental frequency in the time section is represented as a straight line having a gradient $d_j$ (the logarithmic fundamental frequency change). This straight line is represented as an equation (4).

$$\log f_{j+n}=d_j \cdot n+\log f_j \tag{4}$$

On the other hand, if the logarithmic fundamental frequency change is constant in the time section [j−n:j+n], the equation (1) of the harmonic frequency is transformed as an equation (5).

$$\begin{aligned} \log mf_{j+n} &= \log f_{j+n} \log m \\ &= d_j \cdot n + \log f_j + \log m \\ &= d_j \cdot n + \log mf_j \end{aligned} \tag{5}$$

Briefly, if the logarithmic fundamental frequency change is constant in some time section, a time sequence of the harmonic structure is represented as straight lines having a gradient $d_j$ (the logarithmic fundamental frequency change) along the logarithmic frequency axis. Accordingly, by estimating the gradient common to each of the straight lines, the logarithmic fundamental frequency change is calculated without extracting the fundamental frequency and without limiting a range of the fundamental frequency.

Furthermore, even if a part of the harmonic structure is unclear by the background noise, by extracting a common gradient of each of the straight lines, the logarithmic fundamental frequency change having the reduced influence of the background noise is extracted.

In the present embodiment, by using above-mentioned principle, the speech recognition apparatus prepares an apparatus for calculating a fundamental frequency change from an input speech signal. In general, the speech recognition apparatus automatically recognizes a human's speech by a computer. FIG. 1 is a hardware component of the speech recognition apparatus 21. As shown in FIG. 1, for example, the speech recognition apparatus is a personal computer having a CPU (Central Processing Unit) 22, a ROM (Read Only Memory) 23, a RAM (Random Access Memory) 24, a HDD (Hard Disk Drive) 26, a CD (Compact Disc)-ROM drive 28, a communication control apparatus 30, an input apparatus 31, a display apparatus 32, and a bus connecting above units.

The CPU 22 is a main part of the computer, which concentrically controls each section. The ROM 23 is an exclusive use memory to read, which stores various kinds of programs (such as a BIOS) and data. The RAM 24 is a memory to rewritably store various data, which functions as a working area (buffer) of the CPU. The communication control apparatus 30 controls communication between the speech recognition apparatus 21 and the network 29. The input apparatus 31 comprises a keyboard or a mouse, which receives an input of various kinds of operation indication from a user. The display apparatus 32 comprises a CRT (cathode Ray Tube) or a LCD (Liquid Crystal Display), which displays various kinds of information.

The HDD stores various kinds of programs and data, which functions as a main storage apparatus. The CD-ROM drive 28 reads various kinds of programs and data from the CD-ROM 27. In the present embodiment, the CD-ROM 27 stores an OS (Operating System) and various kinds of programs. The CPU 22 reads a program from the CD-ROM 27 by the CD-ROM drive 28, installs the program onto the HDD 26, and realizes each function by executing the program installed.

Figure 2:
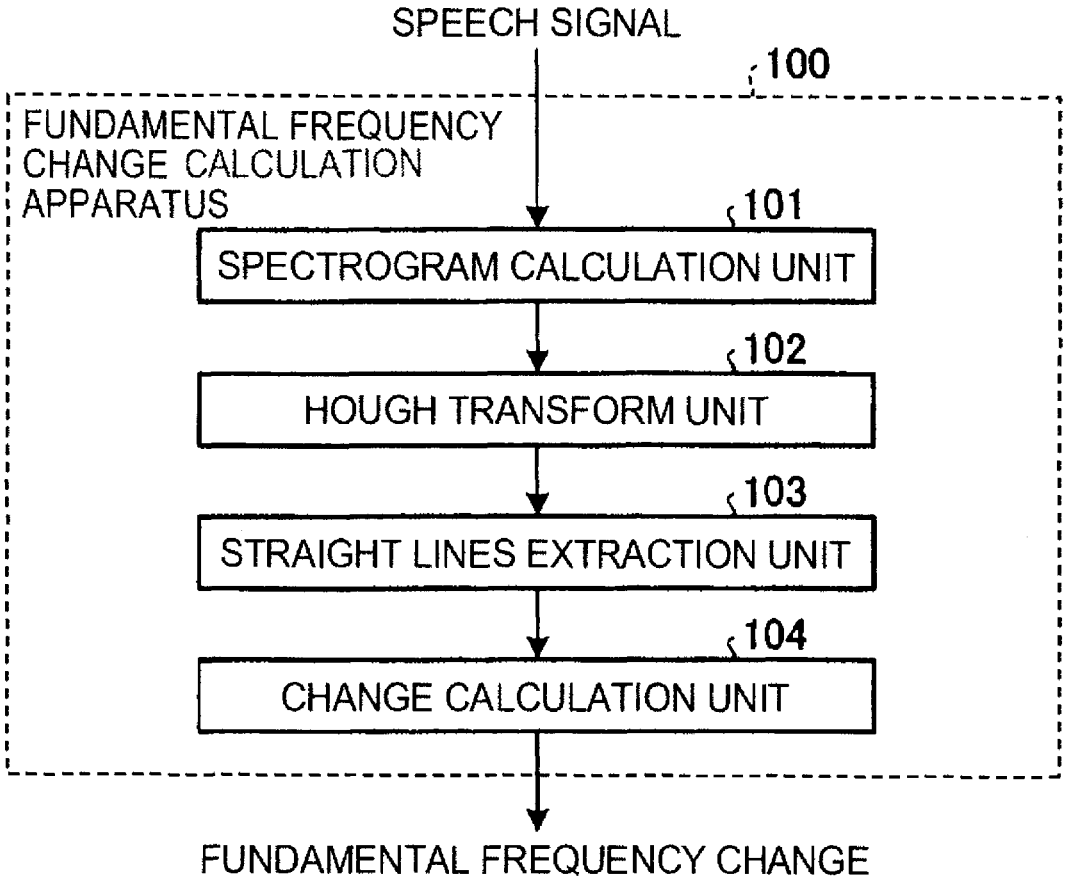
FIG. 2 is a block diagram of a fundamental frequency change calculation apparatus 100 of the one embodiment.

Next, as to each function of the speech recognition apparatus 21 by executing each program (installed onto the HDD 26) with the CPU 22, a fundamental frequency change calculation function, which is peculiar to the present embodiment, is explained. FIG. 2 is a block diagram of the fundamental frequency change calculation function. In FIG. 2, a fundamental frequency change calculation apparatus 100 corresponds to the fundamental frequency change calculation function. The fundamental frequency change calculation apparatus 100 includes a spectrogram calculation unit 101, a Hough transform unit 102, a straight lines extraction unit 103, and a change calculation unit 104.

The spectrogram calculation unit 101 inputs a speech signal having a predetermined time range (For example, 25 ms) at a predetermined interval (For example, 10 ms). This speech signal is called a frame. As to the speech signal of each frame, the spectrogram calculation unit 101 calculates a logarithmic frequency spectrogram having a time (frame) axis and a logarithmic frequency axis by connecting a plurality of logarithmic frequency spectrums each having the predetermined time range along the time axis.

Figure 3:
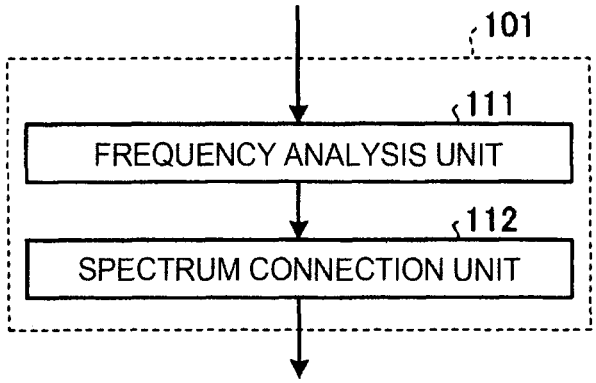
FIG. 3 is a block diagram of a spectrogram calculation unit 101 in FIG. 2.

FIG. 3 is a block diagram of the spectrogram calculation unit 101. The spectrogram calculation unit 101 includes a frequency analysis unit 111 and a spectrum connection unit 112. The frequency analysis unit 111 analyzes a frequency of each frame, and calculates a logarithmic frequency spectrum having a frequency element at equal intervals along the logarithmic frequency axis. Concretely, by executing Fourier transform or Wavelet transform based on frequency points at equal intervals along the logarithmic frequency axis, the frequency analysis unit 111 calculates the logarithmic frequency spectrum. Otherwise, as to a linear frequency spectrum calculated by Fourier transform or Wavelet transform based on frequency points at equal intervals along a linear frequency axis, the frequency analysis unit 111 calculates the logarithmic frequency spectrum by converting a frequency axis of the linear frequency spectrum. The spectrum connection unit 112 connects logarithmic frequency spectrums each having a predetermined time range along the time axis. As a result, a logarithmic frequency spectrogram is generated.

In FIG. 2, the Hough transform unit 102 regards the logarithmic frequency spectrogram (calculated by the spectrogram calculation unit 101) as a two-dimensional plane having a value (brightness) of frequency element, and executes Hough transform to detect a straight line by voting the value of frequency element on the two-dimensional plane. A value of the voted result is called a voted value, and a space having the voted values distributed is called a Hough plane. The Hough transform unit 102 outputs the voted value on the Hough plane.

The straight lines extraction unit 103 extracts straight lines (object used for calculation of the fundamental frequency change) and voted values (object voted value) of the straight line using the voted value output from the Hough transform unit 102. As mentioned-above, the straight lines are a group of straight lines having the same gradient, which represents a time series of a harmonic structure in the logarithmic frequency spectrogram.

Figure 4:
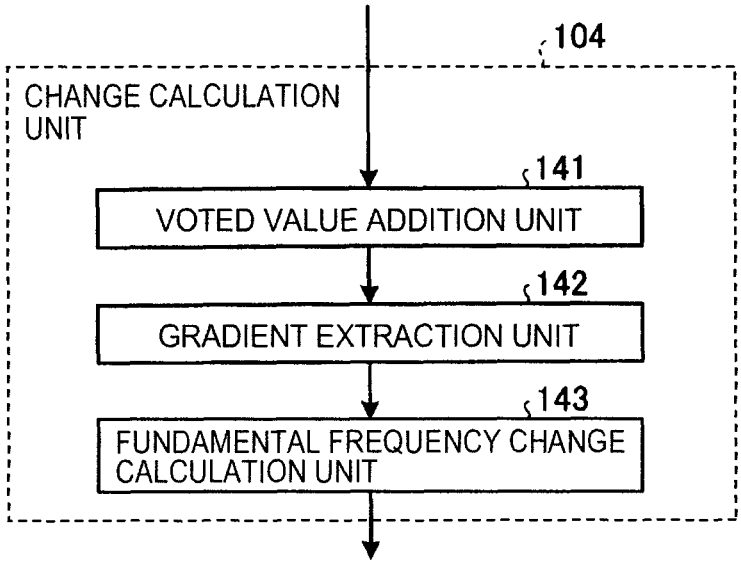
FIG. 4 is a block diagram of a change calculation unit 104 in FIG. 2.

The change calculation unit 104 calculates a fundamental frequency change using the straight lines and object voted values (extracted by the straight lines extraction unit 103) FIG. 4 is a block diagram of the change calculation unit 104. The change calculation unit 104 includes a voted value addition unit 141, a gradient extraction unit 142, and a fundamental frequency change calculation unit 143. The voted value addition unit 141 calculates a sum of object voted values along all straight lines having the same gradient. The gradient extraction unit 142 searches a maximum of the sum of object voted values corresponding to each gradient of straight lines (calculated by the voted value addition unit 141), and extracts a gradient corresponding to the maximum. The fundamental frequency change calculation unit 143 calculates a logarithmic fundamental frequency change using the gradient (extracted by the gradient extraction unit 142), a maximum (For example, 1600 Hz) and a minimum (For example, 200 Hz) of frequency along the linear frequency axis. The logarithmic fundamental frequency change corresponds to a time change of fundamental frequency, i.e., a fundamental frequency change. In this way, the fundamental frequency change calculation unit 143 outputs the fundamental frequency change.

Figure 5:
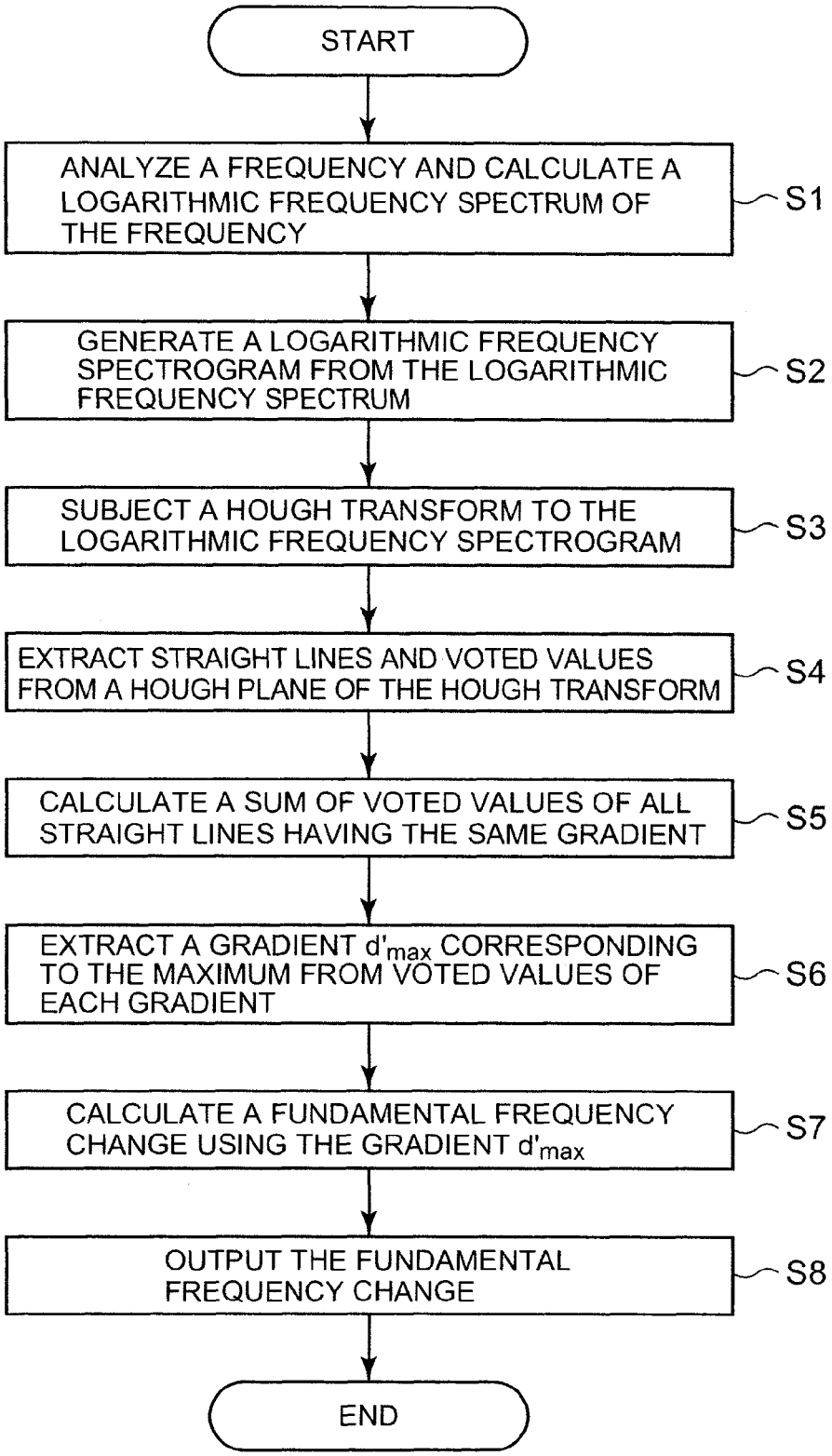
FIG. 5 is a flow chart of processing of the fundamental frequency change calculation apparatus in FIG. 2.

Next, processing to extract a fundamental frequency change by the fundamental frequency change calculation apparatus 100 is explained by referring to FIG. 5. The frequency analysis unit 111 of the spectrogram calculation unit 101 analyzes a frequency of each frame from the input speech signal, and calculates a logarithmic frequency spectrum $S_t(w)$ having frequency elements at equal intervals along the logarithmic frequency axis (S1). In this case, "$t(0<t\leq T)$" represents a number (frame number) added to a frame of processing object, "$w(0\leq w<W)$" represents a number (frequency point number) added to a frequency point along the logarithmic frequency axis, and "$S_t(w)$" represents a value (power) of frequency element at "t" and "w". In case of calculating the logarithmic frequency spectrum, for example, by setting a frequency element range to "200 Hz~1600 Hz" (a range having a large speech energy relatively), the logarithmic frequency spectrum hardly affected by the background noise is acquired.

Next, the spectrum connection unit 112 connects logarithmic frequency spectrums included in a frame section having (adjacent to) a frame t. As a result, a logarithmic frequency spectrogram $SG_t(n,w)$ is generated (S2). "$SG_t(n,w)$" represents a speech (logarithmic) power at a frame n (included in a frame section adjacent to a frame t) and a frequency point number w along the logarithmic frequency axis. As the frame section as a connection object, a section [t−N:t+N] having a fixed width N before and after the frame t, a section [t−N:t] having the fixed width after the frame t, or a section [t:t+N] having the fixed width before the frame t, are alternatively used. However, the frame section is not limited to above examples.

Figure 6:
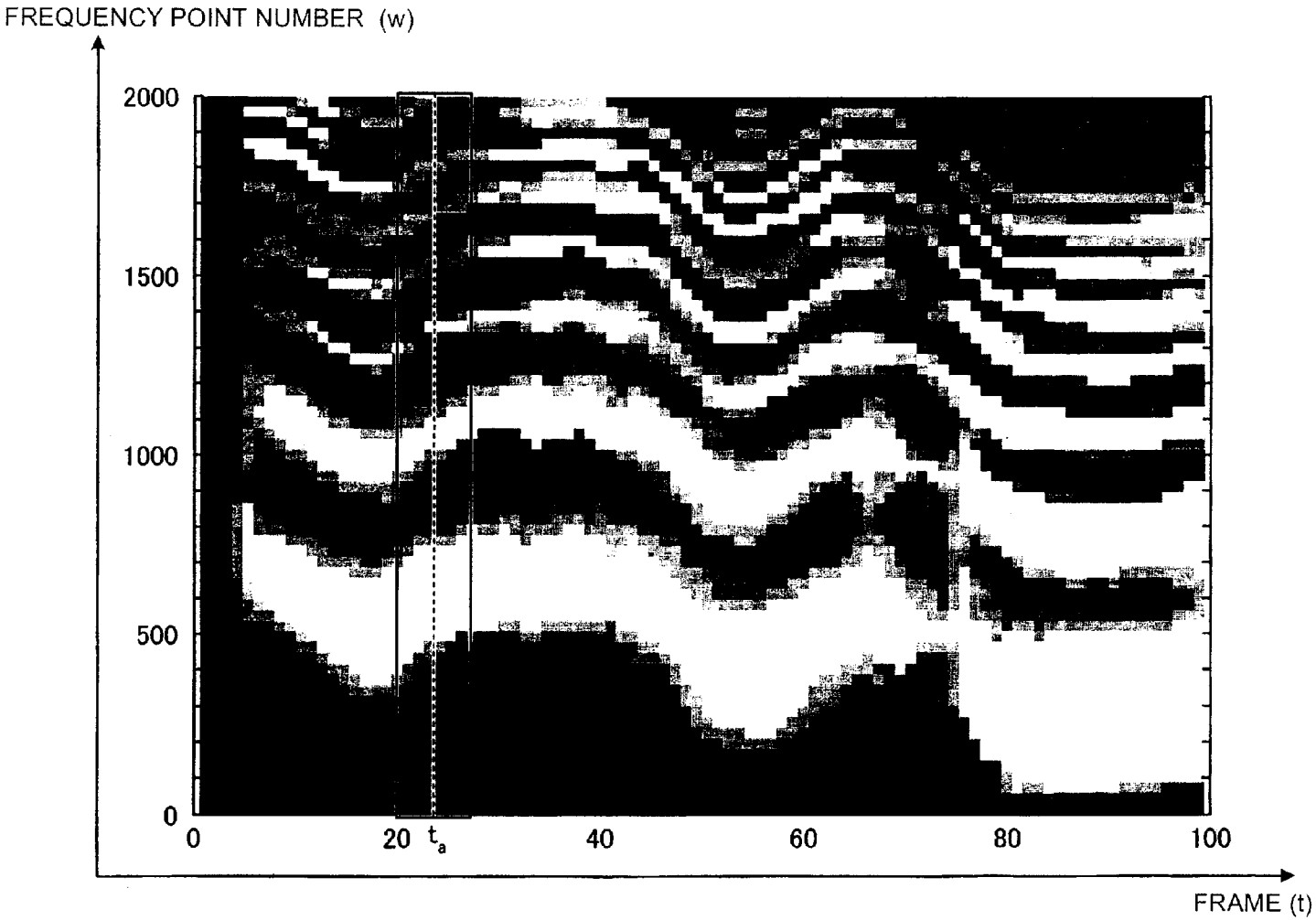
FIG. 6 is one example of a logarithmic frequency spectrogram of the speech signal.

FIG. 6 is one example of the logarithmic frequency spectrogram of the speech signal. A horizontal axis represents a frame number t, and a vertical axis represents a frequency point number w along the logarithmic frequency axis. Furthermore, light and shade of a color represents a value (strength) of frequency element, i.e., the lighter the color is, the stronger the frequency element is. In FIG. 6, a plurality of frequency bands each having a strong frequency element is arranged, and continuously varies with passage of time. Each region corresponds to a harmonic element of a voiced sound. Another region not having the harmonic element corresponds to an unvoiced sound or a silent part. Furthermore, a frame line in FIG. 6 represents a frame section to be connected (by the spectrum connection unit 112) at a frame $t_a$.

Figure 7:
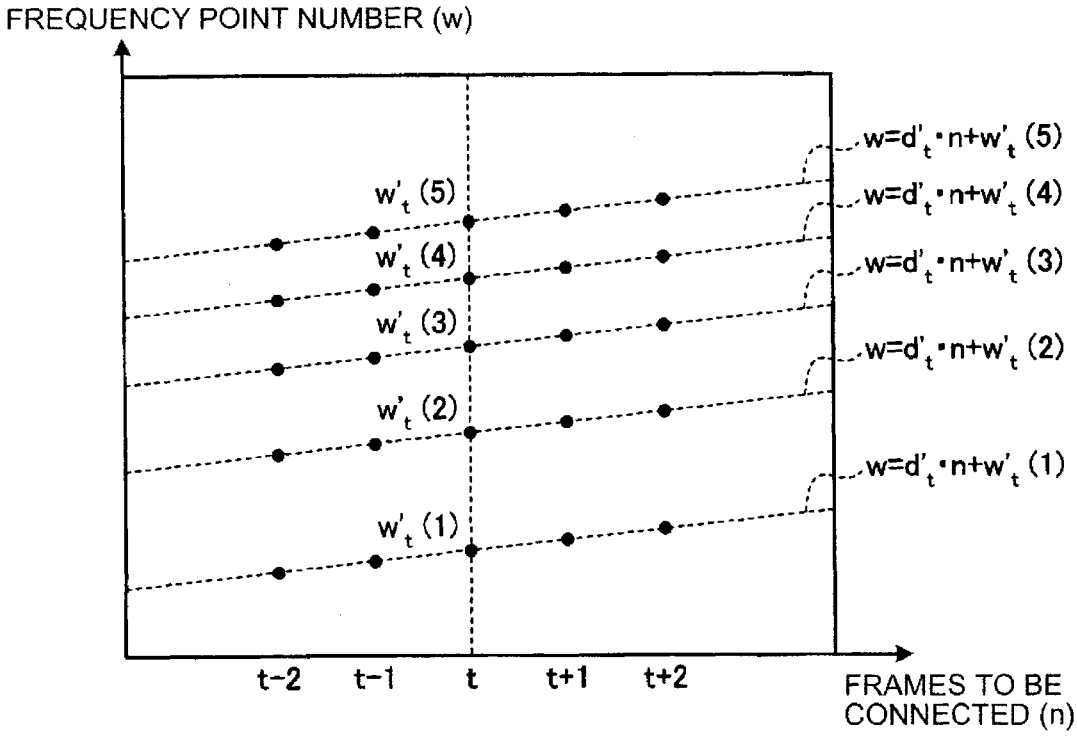
FIG. 7 is a schematic diagram of the logarithmic frequency spectrogram of a frame t.

FIG. 7 is a schematic diagram of the logarithmic frequency spectrogram generated at the frame t. A horizontal axis represents a frame n, and a vertical axis represents a frequency point number w along the logarithmic frequency axis. Furthermore, a frame section to be connected is [t−2:t+2], and each point represents a position of the harmonic element in each frame. As shown in FIG. 7, if a logarithmic fundamental frequency change is constant within a frame section [t−2:t+2] of the logarithmic frequency spectrogram $SG_t(n,w)$, a time series of each harmonic element is represented as straight lines having the same gradient. In this case, each straight line is represented as an equation (6).

$$w=d'_t\cdot n+w'_t(m) \tag{6}$$

In the equation (6), "$w'_t(m)$" represents a frequency point number of m-th harmonic element of the frame t along the logarithmic frequency axis. Furthermore, "$d'_t$" represents the logarithmic fundamental frequency change of the frame t by the frequency point number along the logarithmic frequency axis, which corresponds to the same gradient of the straight lines. In this case, "$d'_t$" has a relationship with a logarithmic fundamental frequency change "$d_t$" as an equation (7). In the equation (7), "$F_{max}$" represents a maximum (For example, 1600 Hz) of frequency along the linear frequency axis, and "$F_{min}$" represents a minimum (For example, 200 Hz) of frequency along the linear frequency axis.

$$d'_t = \frac{W}{\log(F_{max}) - \log(F_{min})} \cdot d_t \tag{7}$$

In FIG. 5, as to a logarithmic frequency spectrogram $SG_t(n,w)$ generated at S2, the Hough transform unit 102 regards as a two-dimensional plane having a value (brightness) of frequency element, and executes Hough transform to detect a straight line by voting the value of frequency element (S3). As one example of Hough transform, assume that a plane (x,y) having a straight line "$y=a_px+b_p$" is transformed to a Hough plane (a,b). In this case, "$a_p$" represents a gradient of the straight line, and "$b_p$" represents an intercept of the straight line. The straight line "$y=a_px+b_p$" on the plane (x,y) is transformed onto a point $(a_p,b_p)$ on the Hough plane (a,b). Briefly, a brightness (value of frequency element) of each point along the straight line "$y=a_px+b_p$" is accumulatively voted onto the point $(a_p,b_p)$. This accumulated value at the point $(a_p,b_p)$ is a voted value. The voted value at the point $(a_p,b_p)$ of the frame t is $H_t(a_p,b_p)$.

Next, as to the logarithmic frequency spectrogram $SG_t(n, w)$, Hough transform to detect a straight line is explained. As mentioned above, if a logarithmic fundamental frequency change is constant in the logarithmic frequency spectrogram $SG_t(n,w)$, a time series of the harmonic element is represented as straight lines having the same gradient. By executing Hough transform to the logarithmic frequency spectrogram, each straight line "$w=d'_t \cdot n+w'_t(m)$" of the straight lines is transformed at a point $(d'_t,w'_t(m))$ on the Hough plane (d',w'). Briefly, each of the straight lines is transformed at a point along a straight line "$d'=d'_t$" on the Hough plane. Furthermore, a brightness (value of the frequency element) of each point along a straight line "$w=d'_t \cdot n+w'_t(m)$" is accumulatively voted as $H_t(d'_t, w'_t(m))$.

As shown in FIG. 6, as to the logarithmic frequency spectrogram of the speech signal, the lighter the color is (the larger the brightness is), the stronger the frequency element is. A fundamental frequency or a harmonic frequency has the frequency element stronger than another frequency band. Accordingly, as to the point $(d'_t,w'_t(m))$ to which each point along a straight line of fundamental frequency or harmonic frequency is transformed on the Hough plane, $H_t(d'_t,w'_t(m))$ is the voted value larger than another frequency band.

On the Hough plane (d',w'), a range of d' is desirably limited based on a range (For example, within ±1 octave) of the fundamental frequency change of the frame section connected by the spectral connection unit 112 at S2. As a result, a time and a memory capacity necessary for calculation can be reduced.

Furthermore, on the Hough plane (d',w'), a range of w' is desirably limited based on a range (For example, OHz~400 Hz) of the fundamental frequency. As a result, a time and a memory capacity necessary for calculation can be reduced.

Figure 8:
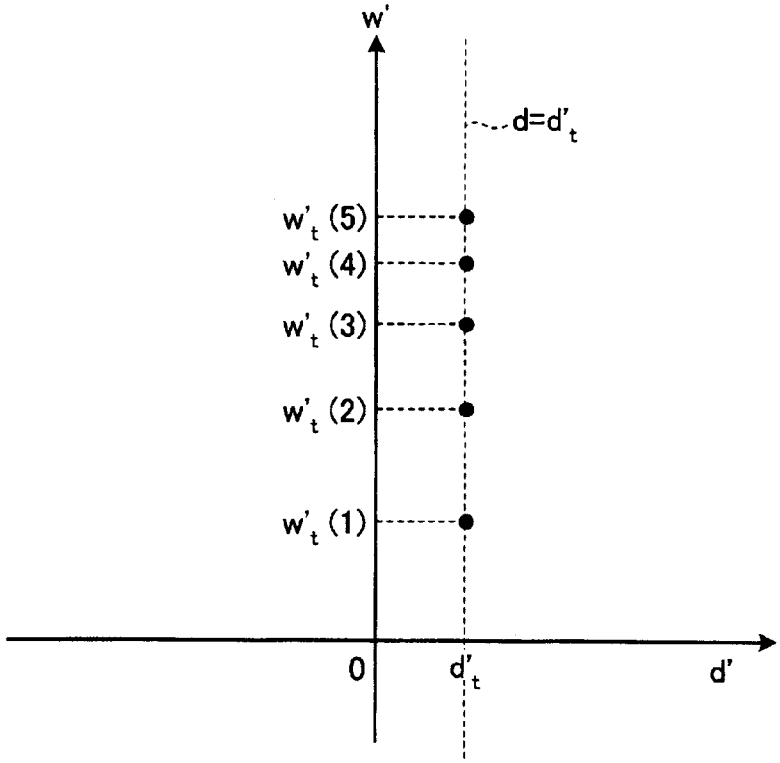
FIG. 8 is a schematic diagram of a Hough plane acquired by subjecting Hough transform to the logarithmic frequency spectrogram in FIG. 7.

FIG. 8 is the Hough plane acquired by executing Hough transform to the logarithmic frequency spectrogram $SG_t(n,w)$ of FIG. 7. In FIG. 8, each point represents $(d'_t,w'_t(m))$ at which a straight line (a time series) of each harmonic element is transformed. In FIG. 8, a gradient of each of the straight lines are same. Accordingly, each point at which a straight line (a time series) of each harmonic element is transformed is arranged along a straight line "d=d'". In this way, the Hough transform unit 102 outputs the voted value $H_t(d',w'(m))$ on the Hough plane.

Next, in FIG. 5, by using the voted value $H_t(d',w'(m))$ on the Hough plane (output at S3), the straight line extraction unit 103 extracts straight lines (included in the logarithmic frequency spectrogram generated at S2) and a voted value (object voted value) to calculate a fundamental frequency change (S4). In this case, the object voted value corresponding to a straight line "$w=d' \cdot n+w'$" in the logarithmic frequency spectrogram $SG_t(n,w)$ at a frame t is $C_t(d',w')$.

As mentioned-above, a voted value $H_t(d',w'(m))$ of each point, which straight lines "$w=d'_t \cdot n+w'_t$" (time series) of harmonic structures are transformed on the Hough plane, is a larger value. Accordingly, by extracting a larger value from the voted value $H_t(d',w'(m))$, straight lines of time series of harmonic elements are extracted (the object voted value of the straight lines is larger).

For example, as to the voted value $H_t(d',w'(m))$, the straight lines extraction unit 103 selects an object voted value by a threshold θ as an equation (8). Briefly, by selecting a voted value larger than the threshold θ, the straight lines extraction unit 103 extracts the object voted value to calculate a fundamental frequency change from all voted values. The threshold θ may be previously determined or dynamically determined.

$$C_t(d', w') = \begin{cases} H_t(d', w') & H_t(d', w') \geq \theta \\ 0 & H_t(d', w') < \theta \end{cases} \tag{8}$$

Furthermore, in order to extract the object voted value, the straight lines extraction unit 103 may select voted values $H_t(d',w'(m))$ within a predetermined rank in order of larger value.

Next, the voted value addition unit 141 in the change calculation unit 104 calculates a sum of object voted values of all straight lines having the same gradient d' from the straight lines "$w=d' \cdot n+w'$" extracted at S4 (S5).

Figure 9:
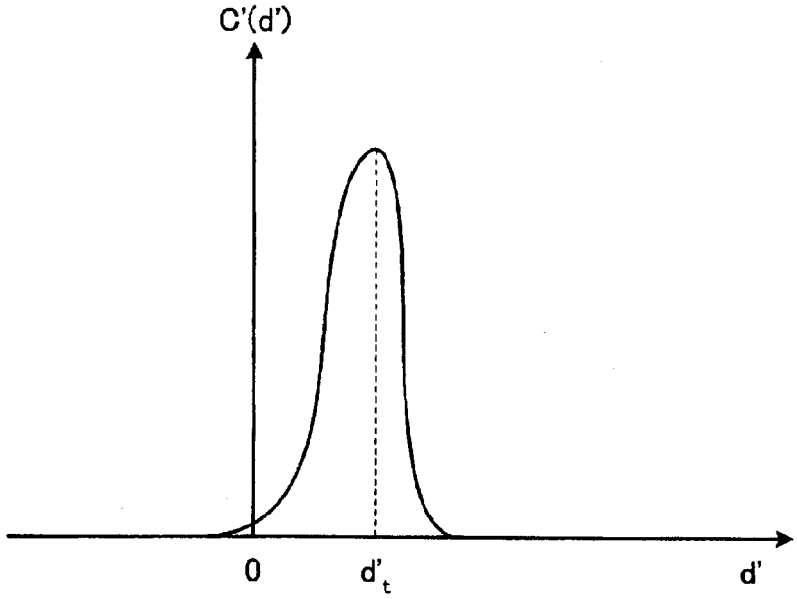
FIG. 9 is a graph representing a sum of voted value of a gradient d' calculated from the Hough plane in FIG. 8.

FIG. 9 is a graph of the sum of object voted values of each gradient d' calculated at S5 from the Hough plane of FIG. 8. In FIG. 9, a horizontal axis represents a gradient d', and a vertical axis represents the sum C'(d') of object voted values. As mentioned-above, straight lines of time series of harmonic structures have the same gradient $d'_t$, and voted values of the straight lines are larger. Accordingly, as shown in FIG. 9, a sum of all voted values of the straight lines having the same gradient $d'_t$ is very large.

Next, in FIG. 5, the gradient extraction unit 142 searches a maximum C'(d') of object voted values of each gradient d' (calculated at S5), and extracts a gradient $d'_{max}$ corresponding to the maximum (S6).

After that, the fundamental frequency change calculation unit 143 calculates $d_{max}$ from $d'_{max}$ by an equation (9). Accordingly, if the same gradient $d'_t$ of straight lines of time series of harmonic structures is extracted as $d'_{max}$, $d_{max}$ is equal to a logarithmic fundamental frequency change $d_t$. Briefly, as a calculation result of the equation (9), the logarithmic fundamental frequency change $d_t$ is acquired.

$$d_{max} = \frac{\log(F_{max}) - \log(F_{min})}{W} \cdot d'_{max} \tag{9}$$

Last, the fundamental frequency change calculation unit 143 outputs a logarithmic fundamental frequency change $d_t$ acquired at S7 (S8).

As mentioned-above, if a logarithmic fundamental frequency change is constant in some time section, on a logarithmic frequency spectrogram calculated in the time section, harmonic structures are represented as straight lines continuously along the time axis, and a gradient of each of the straight lines is equal to the logarithmic fundamental frequency change. Accordingly, by estimating the gradient common to the straight lines, the fundamental frequency change can be acquired without extracting a fundamental frequency and without limiting a rage of the fundamental frequency.

Furthermore, even if a part of the harmonic structure is unclear by a background noise, by extracting the gradient commonly included in each of the straight lines, the fundamental frequency change having the reduced influence of the background noise can be acquired.

In the present embodiment, before executing Hough transform at S3, the fundamental frequency change calculation apparatus 100 may extract feature points from the logarithmic frequency spectrogram $SG_t(n,w)$. When Hough transform is executed at S3, by voting onto the Hough plane using the feature points, a time and a memory capacity necessary for calculation can be reduced.

As a method for extracting feature points, for example, following methods are used, but not limited. As a first method, a brightness (strength of frequency element) of the logarithmic frequency spectrogram $SG_t(n,w)$ is compared with a threshold, and points each having the brightness larger than the threshold are extracted as the feature points, The threshold is different from above-mentioned threshold θ, but may be equal. Furthermore, the threshold may be previously determined, or dynamically calculated.

As a second method, in order of larger brightness on the logarithmic frequency spectrogram $SG_t(n,w)$, points each having the brightness within a predetermined rank are extracted as the feature points. The predetermined rank may be same as above-mentioned predetermined rank used for the straight lines extraction unit 103 to extract voted values, or may be different.

In the present embodiment, a logarithmic frequency spectrum calculated by the frequency analysis unit 111 may be a residual element of the logarithmic frequency spectrum from which a spectrum envelope element is removed. The residual element pf the logarithmic frequency spectrum may be acquired from a residual signal acquired by linear prediction analysis, or may be acquired by subjecting Fourier transform to high-order element of Cepstrum.

The logarithmic frequency spectrum calculated by the frequency analysis unit 111 may be a logarithmic Cepstrum. Furthermore, the logarithmic frequency spectrum calculated by the frequency analysis unit 111 may be a logarithmic autocorrelation function.

In the present embodiment, a logarithmic frequency spectrogram calculated by the spectrum connection unit 112 may be the logarithmic frequency spectrogram having a normalized amplitude. As a method for normalizing amplitude, for example, following methods are used.

As a first method, an average of amplitude of the logarithmic frequency spectrogram is set as a fixed value (For example, "0"). As a second method, a minimum and a maximum of the amplitude are set as a fixed value (For example, "0" and "1") respectively. As a third method, a distributed value of the amplitude of a speech waveform to calculate the logarithmic frequency spectrogram is set as a fixed value (For example, "1").

In the present embodiment, the fundamental frequency change calculation apparatus is applied to the speech recognition apparatus. However, the fundamental frequency change calculation apparatus having above-mentioned function may be applied to a speaker identification apparatus which requires a fundamental frequency change.

In the disclosed embodiments, the processing can be performed by a computer program stored in a computer-readable medium.

In the embodiments, the computer readable medium may be, for example, a magnetic disk, a flexible disk, a hard disk, an optical disk (e.g., CD-ROM, CD-R, DVD), an optical magnetic disk (e.g., MD). However, any computer readable medium, which is configured to store a computer program for causing a computer to perform the processing described above, may be used.

Furthermore, based on an indication of the program installed from the memory device to the computer, OS (operation system) operating on the computer, or MW (middle ware software) such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

Other embodiments of the invention will be apparent to those skilled in the art from consideration of the specification and embodiments of the invention disclosed herein. It is intended that the specification and embodiments be considered as exemplary only, with the scope and spirit of the invention being indicated by the claims.

What is claimed is:

1. An apparatus for calculating a fundamental frequency change, comprising:

a spectrogram calculation unit configured to calculate a logarithmic frequency spectrum by analyzing a frequency of a frame having a predetermined time range divided from a speech signal, the logarithmic frequency spectrum having a frequency element at equal intervals along a logarithmic frequency axis, and to calculate a logarithmic frequency spectrogram by connecting a plurality of logarithmic frequency spectrums of frames adjacent along a time axis;

a Hough transform unit configured to vote a value of the frequency element along a straight line on the logarithmic frequency spectrogram onto a Hough plane, the Hough plane having a voted value in correspondence with a gradient of the straight line;

an extraction unit configured to extract the voted value larger than a threshold and the gradient corresponding to the voted value from the Hough plane; and a change calculation unit configured to calculate a fundamental frequency change using the voted value and the gradient extracted.

2. The apparatus according to claim 1, wherein the logarithmic frequency spectrogram is represented on a two-dimensional plane defined by the time axis and the logarithmic frequency axis.

3. The apparatus according to claim 1, wherein the voted value is a sum of values of all frequency elements along the straight line on the logarithmic frequency spectrogram, and the Hough plane has the voted value in correspondence with the gradient and an intercept of the straight line.

4. The apparatus according to claim 1, wherein the extraction unit extracts the voted value within a predetermined rank in order of larger value from the Hough plane.

5. The apparatus according to claim 1, wherein the change calculation unit comprises a voted value addition unit configured to calculate a sum of voted values extracted from straight lines having the same gradient, a gradient extraction unit configured to extract a gradient corresponding to the largest sum from the Hough plane, and a fundamental frequency change calculation unit configured to calculate the fundamental frequency change using the gradient extracted.

6. The apparatus according to claim 5, wherein the fundamental frequency change calculation unit calculates the fundamental frequency change using the gradient, a maximum and a minimum of frequency along a linear frequency axis.

7. The apparatus according to claim 1, further comprising a feature point extraction unit configured to extract the frequency element having the value larger than another threshold or a predetermined number of the frequency elements having a larger value from the logarithmic frequency spectrogram, wherein the Hough transform unit votes using the values of the frequency elements extracted.

8. A method for calculating a fundamental frequency change, comprising:

calculating a logarithmic frequency spectrum by analyzing a frequency of a frame having a predetermined time range divided from a speech signal, the logarithmic frequency spectrum having a frequency element at equal intervals along a logarithmic frequency axis;

calculating a logarithmic frequency spectrogram by connecting a plurality of logarithmic frequency spectrums of frames adjacent along a time axis;

voting a value of the frequency element along a straight line on the logarithmic frequency spectrogram onto a Hough plane, the Hough plane having a voted value in correspondence with a gradient of the straight line;

extracting the voted value larger than a threshold and the gradient corresponding to the voted value from the Hough plane; and calculating a fundamental frequency change using the voted value and the gradient extracted.

9. A non-transitory computer-readable medium storing program codes for causing a computer to calculate a fundamental frequency change, the program codes comprising:

a first program code to calculate a logarithmic frequency spectrum by analyzing a frequency of a frame having a predetermined time range divided from a speech signal, the logarithmic frequency spectrum having a frequency element at equal intervals along a logarithmic frequency axis;

a second program code to calculate a logarithmic frequency spectrogram by connecting a plurality of logarithmic frequency spectrums of frames adjacent along a time axis;

a third program code to vote a value of the frequency element along a straight line on the logarithmic frequency spectrogram onto a Hough plane, the Hough plane having a voted value in correspondence with a gradient of the straight line;

a fourth program code to extract the voted value larger than a threshold and the gradient corresponding to the voted value from the Hough plane; and a fifth program code to calculate a fundamental frequency change using the voted value and the gradient extracted.

* * * * *